US005423483A

United States Patent [19]

Schwade

[11] Patent Number: 5,423,483

[45] Date of Patent: Jun. 13, 1995

[54] SOOTBLOWER

[76] Inventor: Hans H. Schwade, 469 E. Wesley Rd., Atlanta, Ga. 30305

[21] Appl. No.: 152,304

[22] Filed: Nov. 12, 1993

[51] Int. Cl.[6] ..... B08B 3/02

[52] U.S. Cl. ..... 239/11; 15/316.1; 122/392; 165/95; 239/557; 239/589

[58] Field of Search ..... 15/316.1, 317, 318, 15/318.1; 122/390, 392; 165/95; 239/557, 589, 601, DIG. 13, 11

[56] References Cited

U.S. PATENT DOCUMENTS

| | | | |
|---|---|---|---|
| 3,138,819 | 6/1964 | McColl | 15/317 |
| 3,570,766 | 3/1971 | Johnson | 239/601 X |
| 3,968,936 | 7/1976 | Brühlmeier | 239/557 X |
| 4,565,324 | 1/1986 | Rebula et al. | 122/390 X |
| 4,803,959 | 2/1989 | Sherrick et al. | 122/379 |
| 4,924,817 | 5/1990 | Seelen | 122/390 X |
| 5,230,306 | 7/1993 | Barringer et al. | 122/390 X |
| 5,271,356 | 12/1993 | Kling et al. | 15/316.1 X |
| 5,277,153 | 1/1994 | Kakabaker | 122/392 X |

FOREIGN PATENT DOCUMENTS 0159128 3/1984 European Pat. Off. .

*Primary Examiner*—Christopher K. Moore
*Attorney, Agent, or Firm*—Hopkins & Thomas

[57] ABSTRACT

A sootblower nozzle head of lance tube has nozzle members, each comprising a plurality of full expansion nozzles positioned closely adjacent and parallel to each other so that the jets from the individual nozzles commingle as they exit the nozzle member to form a common jet, thereby providing the cleaning efficiency of a full expansion nozzle in the limited space available in the head of the sootblower.

11 Claims, 3 Drawing Sheets

SOOTBLOWER

FIELD OF THE INVENTION

This invention relates to a sootblower and is more particularly concerned with a sootblower having nozzle bodies with nozzles which generate fully expanded jets of fluid.

BACKGROUND OF THE INVENTION

The accumulation of fireside deposits on the internal heating surfaces of boilers drastically reduces their thermal efficiency and, if not removed, requires periodic shutdowns of the boiler for manual cleaning. The principal means for removing fireside deposit accumulation in boilers is a cleaning device known as a sootblower which directs jets of fluid cleaning agents, such as steam, air and/or water, against the internal surfaces of the boiler. The cleaning effectiveness of a sootblower depends to a great degree on the nozzle design which controls the mass flow, exit speed and the jet decay characteristics of the exiting jets.

The sootblower nozzle design most commonly used today is based on the de Laval design comprising convergent and divergent flow sections which form a venturi. The pressure of the cleaning agent decreases as it passes through the convergent segment of the nozzle, attaining the speed of sound at the throat of the nozzle. The pressure of the fluid cleaning agent then decreases further through the divergent section, expanding and accelerating from the nozzle throat to the nozzle exit and thereby typically exceeding the speed of sound as the cleaning agent exits. The pressure drop over the divergent section is controlled by the designed geometry of that section.

The cleaning potential of the jet emitted from a nozzle is commonly measured in terms of the jet's Peak Impact Pressure (PIP). The maximum PIP is delivered by nozzles where the pressure of the exiting jet equals the ambient pressure resulting in a "fully expanded" jet. Nozzles which do not allow the pressure of the exiting jet to reach the ambient pressure result in "under expanded" jets. In the case of under expanded jets, the pressure of the exiting jet is higher than the ambient pressure so the exiting jet must finish expanding outside the nozzle causing a series of expansion and contraction waves called "shock waves." These "shock waves" convert a substantial part of the kinetic energy of the jet stream into internal energy, thereby markedly reducing the PIP.

A "full expansion" nozzle is achieved by designing the nozzle with a specific ratio between the area of the nozzle's exit to the area of the nozzles's throat. The ratio is determined by the particular nozzle inlet pressure. In practice, this means the length of the divergent segment of the nozzle, $L_n$, needs to be long enough to allow the full expansion and corresponding drop in pressure of the fluid cleaning agent down to the ambient pressure at the nozzle's exit. However, for most practical sootblower applications, the available space for a nozzle limits the use of conventional full expansion nozzles because their nozzle length is too great as shown in Table 1.

TABLE I

| Nominal Size (in.) | Throat Area (in.$^2$) | Flow Rate (lbs/sec.) | Conventional Nozzle Length (in.) | Full Expansion Nozzle Length (in.) |
|---|---|---|---|---|
| 7/8 | 0.601 | 2.24 | 1.63 | 3.45 |
| 1 | 0.785 | 2.93 | 1.63 | 3.86 |
| 1 1/8 | 0.994 | 3.71 | 1.63 | 4.95 |

*For 300 psi inlet pressure and 600° F. superheated steam.

Consequently, only the shorter under expanded nozzles are used. These circumstances are most apparent with so called long retractable sootblowers, such as the one disclosed in European Patent No. 159,128. The sootblower of the '128 patent uses a lance tube typically having a plurality of nozzles at its working end which are generally positioned opposite to each other, with aligned center axes or slightly staggered center axes in order to offset the jet reaction forces, as seen in FIG. 2 of the '128 patent.

In a conventional sootblower, nearly the whole nozzle member is disposed internally in the nozzle head so that it may be inserted into the boiler furnace through a tight wall box which opens into the boiler wall. Typically the nozzle head outer diameter in conventional sootblowers is 3.5 inches, and the inside diameter is 3.0 inches. Therefore, the length of the sidewise pointed nozzle body cannot exceed approximately 1.63 inches. To obtain the required mass fluid flow for adequate cleaning, a conventional full expansion nozzle requires a length between 3 and 5 inches based on a common inlet pressure of 300 psi and superheated steam of 600° F. Consequently, a conventional sootblower nozzle head is not able to house nozzles capable of generating fully expanded jets.

BRIEF DESCRIPTION OF THE INVENTION

Briefly described, the present invention includes a sootblower having a nozzle member, the nozzles of which produce a fully expanded jet of fluid cleaning agent with the mass flow comparable to conventional nozzles which is achieved by combining the jets of a plurality of parallel small nozzles into a common jet. In more detail, the sootblower nozzle member of the present invention is comprised of a plurality of individual small full expansion nozzles having a sufficiently small throat area, so that the length, $L_n$, of the divergent segment of the nozzle for a fully expanded jet is short enough to allow the nozzle member to be mounted in a conventional sootblower nozzle head.

The small full expansion nozzles of the nozzle member are each of the de Laval type defining a venturi. Because the smaller nozzles do not provide adequate mass flow for sufficient cleaning, the present invention disposes a plurality of these smaller full expansion nozzles in an array or cluster adjacent and parallel to one another so that their exiting jets commingle and form one single full expansion jet column. The combined throat areas of the smaller full expansion nozzles substantially equals the throat area of a comparable conventional nozzle so that the mass flow from the cluster is equal to the mass flow of a conventional nozzle, but the jets from the sootblower of the present invention are fully expanded.

The nozzle members of the present invention are disposed on opposite sides of the nozzle head along a common transverse center axis or slightly staggered to allow for longer nozzle members.

Because of the vast variations in the design and structure of boilers, it is desirable to have nozzles with different blowing characteristics. In the present invention, the configuration and size of the individual nozzles of a single nozzle member may be varied to produce different blowing characteristics.

In one preferred embodiment, four smaller nozzles of the same size are positioned adjacent to one another in a circumferentially equally spaced array so that their center axes are parallel. However, any number of configurations are possible by varying the number and positioning of equally sized nozzles. The greater the number of nozzles used, the smaller each individual nozzle may be to maintain the same mass flow. Consequently, the nozzles members of the present invention may be designed to be installed in sootblowers nozzle heads with extremely small inside diameters.

In another embodiment, nozzles of various sizes are positioned adjacent to one another in order to vary the characteristics of the blowing jet. One configuration is where several larger nozzles are disposed close to the center or hub of the nozzle member and a plurality of smaller nozzles are arranged circumferentially around the larger nozzles, the axes of the nozzles being parallel. Thus, the exiting jets from the smaller outside nozzles generate an envelope for the core jets, reducing the jet decay and furthering its reach.

Accordingly, it is an object of the present invention to provide a sootblower having a nozzle member with nozzles which overcomes the disadvantages of under expansion and allows the use of full expansion nozzles within the available space which accommodates a conventional sootblower.

Another object of the present invention is to provide a sootblower having a nozzle member with nozzles that is more efficient in cleaning fireside deposit accumulation in boilers.

Another object of the present invention is to provide a sootblower having a nozzle member with nozzles which will reduce to a minimum the generation of shock waves and conserve the jet energy for cleaning.

Another object of the present invention is to provide a sootblower having a nozzle member with nozzles which provide jets which will reach a greater distance and are more efficient in cleaning fireside deposit accumulation in a boiler and cover a greater cleaning area.

Another object of the present invention is to provide a more efficient sootblower which will improve the boiler thermal efficiency.

Another object of the present invention is to provide a sootblower which, when used, will lengthen the time between boiler shutdowns for cleaning.

Another object of the present invention is to provide a sootblower that can be easily mounted as a replacement for previously existing sootblowers.

Another object of the present invention is to provide a sootblower which eliminate the need for welding of parts and is more easily fabricated.

Another object of the present invention is to provide a sootblower which is inexpensive to manufacture, durable in structure and efficient in operation.

Another object of the present invention is to provide a sootblower nozzle member which will fit blower tubes of various diameters.

Another object of the present invention is to provide a sootblower with improved cleaning capability and which will conserve the amount of the fluid cleaning agent used.

Another object of the present invention is to provide a sootblower which provides increased cleaning energy over a wide range of nozzle pressures.

Other objects, features and advantages of the present invention will become apparent from the following description when considered in conjunction with the accompanying drawings wherein like characters of reference designate corresponding parts throughout the several views.

DETAILED DESCRIPTION OF THE PREFERRED EMBODIMENT

Figure 1:
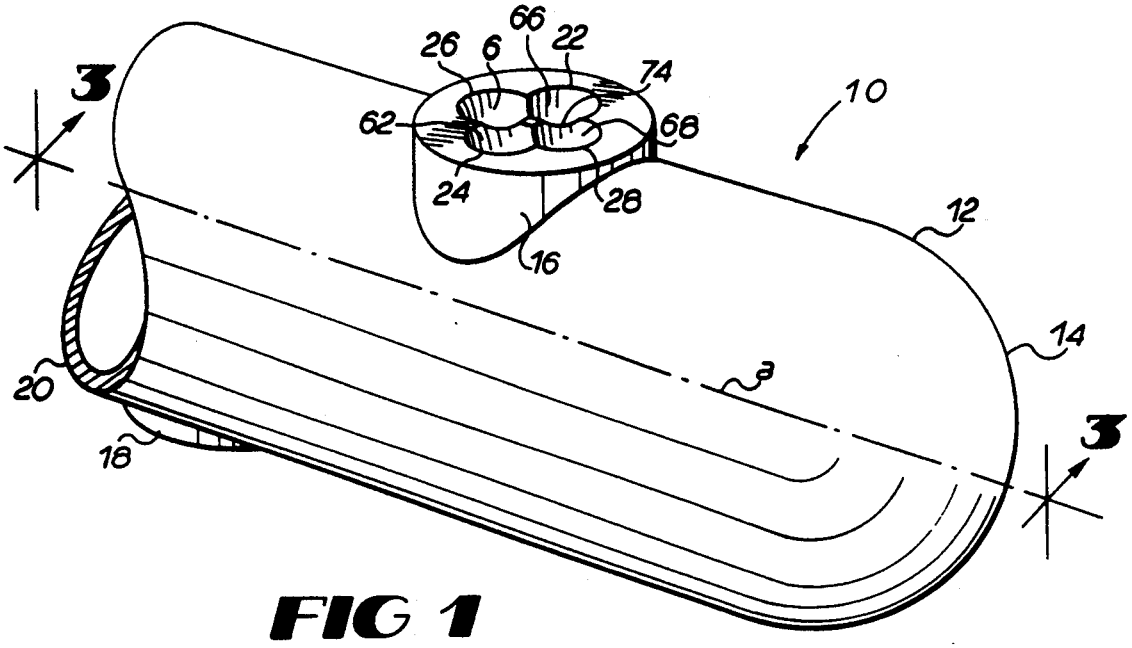
FIG. 1 is a fragmentary perspective view of a portion of a sootblower constructed in accordance with the present invention.

Referring now in more detail to the embodiment chosen for the purpose of illustrating the present invention, numeral 10 in FIG. 1, denotes generally the nozzle head of a-sootblower of the present invention, the nozzle head having a straight hollow tubular cylindrical body 12 which is inserted into a boiler, not shown, where it is rotated and/or oscillated about its longitudinal axis $\alpha$, for spraying a fluid cleaning agent radially of the main body 12 throughout the boiler. The main body is closed at its distal end by a rounded, usually semi-spherical, outwardly protruding end 14.

The main body 12 is about 8 inches long with an outside diameter of approximately 3.5 inches, a wall thickness of approximately 0.25 inches and an inside diameter of about 3.0 inches. Body 12 is integrally joined to an otherwise conventional lance tube, not shown, of the same outside diameter having an opposite end fixed to a motor driven carriage and feed tube, neither of which is shown. The lance tube and body 12 are made of heat resistant material such as stainless steal.

Mounted radially in the cylindrical main body 12 are axially spaced nozzle members 16 and 18, constructed in accordance with the present invention. The nozzle member 16 and 18 are spaced from each other along axis a and are arranged circumferentially at about 180° from each other, so as to discharge simultaneously and in opposite, offset, radial directions.

The nozzle members 16 and 18 are identical, each having an inner, flat, radially extending face or end 50 perpendicular to its central axis B and outer, flat, radially extending face or end 52, also perpendicular to axis B.

Nozzle members 16 and 18 are circular columns machined out of a heat resistant rod material, such as a stainless steal rod, and are respectfully radially received in spaced circumferentially disposed holes, the nozzle members 16 and 18 being fixed in place by welding.

Alternatively, the nozzle head and nozzle members are cast to form an integral piece.

Figure 2:
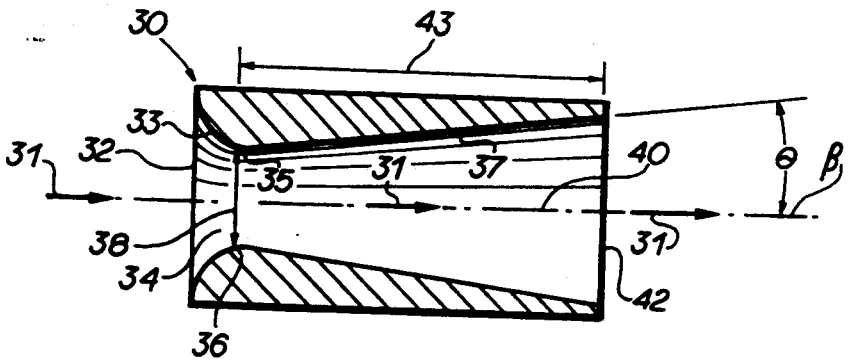
FIG. 2 is a cross-sectional view of a conventional de Laval nozzle.
Figure 3:
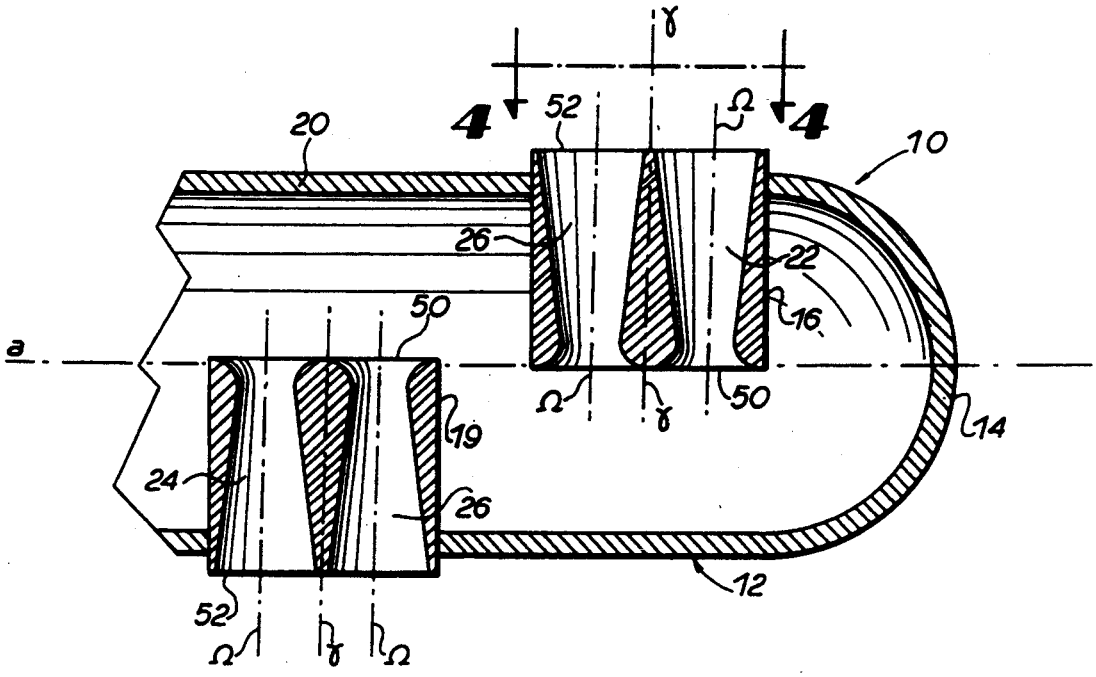
FIG. 3 is a cross-sectional view taken substantially along line 3—3 in FIG. 1.

As depicted in FIGS. 1 and 3, nozzle members 16 and 18 are identical, each having an array of four, juxtaposed, parallel, circumferentially equally spaced nozzles 22, 24, 26 and 28. Each individual nozzle 22, 24, 26 and 28, which is formed in nozzle member 16, is defined by a venturi wall conforming to a conventional de Laval nozzle design, as illustrated in FIG. 2.

This typical de Laval nozzle 30 has a symmetrical nozzle opening along a longitudinal axis B generated by opposed converging walls 33 and 37 which merge at their smaller inner end portions with a circular throat wall 35. In more detail, the entrance wall 33, in cross-section, is convex and the throat wall 35, in cross-section, is also convex, merging with inner edge portion of wall 33 and the inner edge portion of wall 37. The outer wall 37, from throat 38 to mouth 42, is essentially conical, diverging outwardly to the exit and/or mouth 42.

Fluid under pressure, such as steam or other gas or vapor, passes in the direction of arrows 31 into inlet 32 and thence along the converging section 34 defined by wall 33. At the throat 36 defined by throat wall 35, the cleaning agent reaches the speed of sound. The throat diameter 38 controls the mass flow of the fluid through nozzle 30. The fluid, i.e. the cleaning agent, then passes into the diverging section 40 defined by wall 37 where the cleaning agent progressively expands, resulting in a corresponding drop in pressure throughout the length 43 ($L_n$) of the diverging section 40. Thence, the cleaning agent is discharged from the mouth or exit 42.

The de Laval type nozzle 30, described above, allows the full expansion of the exiting cleaning agents when the length 42 ($L_n$) of the diverging section 40 is defined in accordance with the following equation:

$$L_N = \frac{(D_T - D_E)/2}{\tan\theta} \quad (1)$$

where the $D_T$ represents the throat diameter of throat 35 in inches; $\theta$ represents the divergent angle in degrees and $L_N$ the length 43 of the divergent segment in inches. The exit diameter, $D_E$, in equation (1) of the nozzle is defined by the following equation:

$$D_E = 39.37\sqrt{\frac{4 \cdot \dot{m} \cdot V}{44.72 \cdot \pi \cdot \sqrt{\Delta H}}} \quad (2)$$

where $\dot{m}$ represents the mass flow of the cleaning agent in kilograms/seconds, V represents the specific volume of the fluid cleaning agent in meters cubed/kilogram and $\Delta H$ represents the enthalpy in kilojoules/kilogram. The full expansion nozzles of the present invention incorporate smaller throat diameters 38 which mathematically result in shorter divergent section lengths, $L_n$, as is apparent from mathematical equation (1). The decrease in mass flow resulting from a smaller throat area of throat 38, is countered by volume of the exiting jets of fluid of a plurality of the smaller full expansion nozzles, obtaining a mass flow equivalent to a single conventional sootblower nozzle but permitting the fluid to exit at a substantially higher velocity and in individual columns which merge into a single, high velocity moving laminar flow.

Figure 5A:
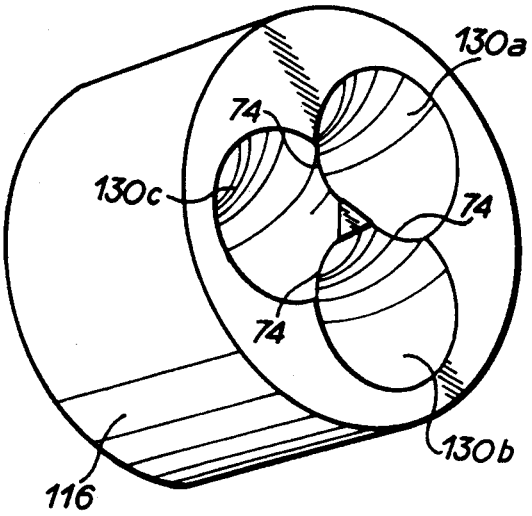
FIG. 5A is a perspective view of a nozzle member of an alternative embodiment of the present invention.

As shown in FIG. 5A, the present invention incorporates a minimum cluster of three (3) individual nozzles **103*a*, 130*b* and 130*c* in a circular array about central hub 140** to a maximum cluster of seven (7) individual nozzles in a circular array.

A sootblower nozzle head 12 should usually have two nozzle members 16 and 18, but as many as six (6) may be incorporated in any one nozzle head 12 depending upon the specific cleaning needs of the particular boiler.

Table II indicates the size of a conventional nozzle which can be replaced with a plurality of full expansion nozzles in an array according to the present invention, while maintaining the same total throat area, flow rate and nozzle length.

TABLE II

| Nominal Size (in.) | Number Of Nozzles | Size Of Each Nozzle (in.) | Combined Total Throat Area (in.$^2$) | Combined Flow Rate (lbs./sec.) | Nozzle Length (in.) |
|---|---|---|---|---|---|
| 7/8 | 4 | 7/16 | 0.601 | 2.24 | 1.85 |
| 1 | 4 | .5 | 0.785 | 2.93 | 2.05 |
| 1 1/8 | 5 | .5 | 0.982 | 3.67 | 2.05 |

Figure 4:
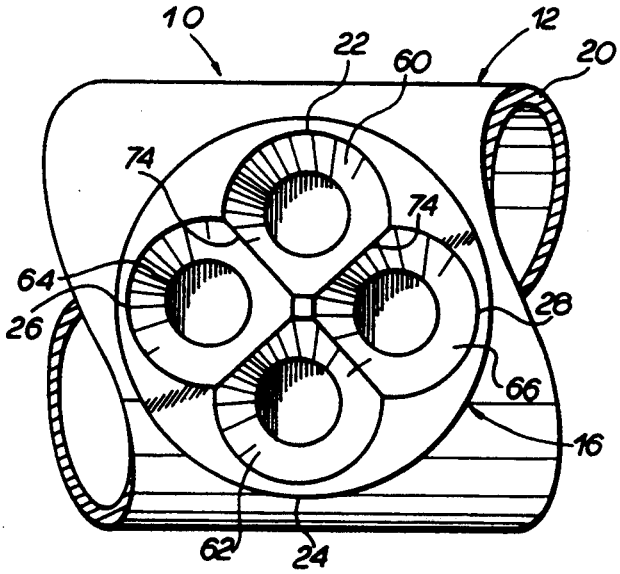
FIG. 4 is a top plan view of the sootblower depicted in FIGS. 1 and 3.

As best seen in FIG. 4, nozzle member 16 defines four full expansion nozzles 22, 24, 26 and 28 substantially identical to the nozzle of FIG. 2. Nozzles 22, 24, 26 and 28 each have conically shaped diverging sections 60, 62, 63 and 64 respectively, and cortically shaped converging sections not shown. Nozzles 22, 24, 26 and 28 are milled or bored into the stock of nozzle device 16. The central axes $\omega$ of nozzles 22, 24, 26 and 28 are circumferentially equally spaced, running parallel to central axis $\gamma$ of nozzle member 16 or 18.

As shown in FIGS. 1 and 4, the diverging section walls 60 and 66 meet at a common parabolic shaped edge 74. The cleaning agents in nozzles 22 and 28 thus begin to commingle in the portion of the nozzle member 16 as they pass common edge 74 and before exit 52. In a similar manner, the jets of any two adjacently disposed nozzles commingle prior to exiting the nozzle device.

In an alternative embodiment of the present invention, as shown in FIG. 5A, three nozzles **130*a*, 130*b* and 130*c* are aligned in a circumferentially equally spaced array. The three nozzle array configuration shown in FIG. 5A incorporates all the functional characteristics described in the four nozzle array configuration of FIGS. 1, 3 and 4**.

Figure 5B:
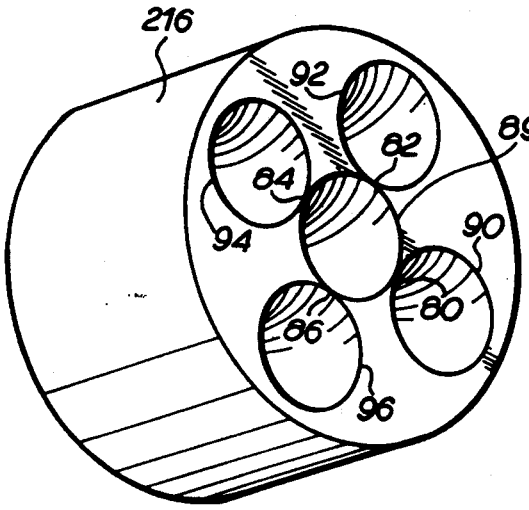
FIG. 5B is a perspective view of another nozzle member of an alternative embodiment of the present invention.

Another embodiment depicted in FIG. 5B, shows five nozzles **230*a*, 230*b*, 230*c*, 230*d* and 230*e* incorporated in the nozzle member 216. In the five nozzle array configuration shown in FIG. 5B, the central nozzle 230*e* is surrounded by the four equally spaced outer nozzles 230*a*, 230*b*, 230*c* and 230*e***, all having common axes.

Figure 5C:
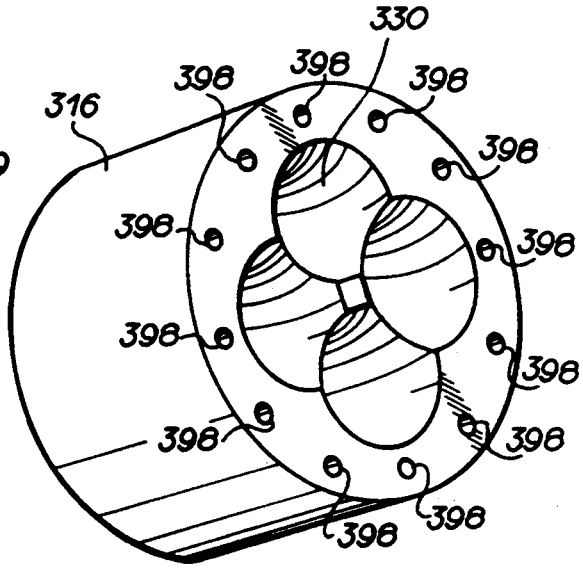
FIG. 5C is a perspective view of still another nozzle member of an alternative embodiment of the present invention.

Another embodiment is depicted in FIG. 5C, wherein the four nozzle configuration 330, similar to the configuration in nozzle member 16 and 1.8, are circumferentially surrounded by equally spaced smaller nozzles 398. The discharges from these nozzle bore tend to encompass the discharges from the central nozzles 330.

Another factor to the proximity of adjacent devices is the size of the nozzle members themselves. The nozzle members 16, 18, 116, 216, 316 each have a maximum nozzle length of approximately 2.05 inches and a minimum nozzle length of approximately 1.85 inches, and a maximum nozzle member outside diameter of approximately 3 inches and minimum nozzle member outside diameter of approximately 2.25 inches.

OPERATION

From the foregoing description, the operation of the present invention should be apparent. The individual nozzles of each nozzle member 16, 18, 216, 316 discharge a cleaning agent from the nozzle head, such as head 12. The cleaning agent compresses as it passes through the throat of each individual nozzle. The cleaning agent then expands as it passes through the diverging section of the nozzle. Because the individual nozzles of a cluster are respectfully of such size and configuration, the pressure of the cleaning agent passing through the nozzles fully expands and substantially reaches ambient pressure at its exit from the mouths of the individual nozzles. Consequently, there is no appreciable tendency of the exiting jet to expand after exiting the nozzle, eliminating the resulting vortex of cleaning agent particles progressively moving outwardly and forwardly and the associated "shock waves" which reduces the exiting jet's cleaning efficiency.

Instead, there is a plurality of parallel columns of a cleaning agent which merge prior to discharge from the nozzle device to form a larger unitary tubular column. The cleaning efficiency of the exiting cleaning agent is preserved due to the essentially laminar flow of the particles in the column of exiting cleaning agent. Therefore, the cleaning agent in such a column will travel a greater distance and have greater cleaning capabilities than a cleaning agent emerging from a conventional nozzle.

It will be obvious to those skilled in the art that many variations may be made in the embodiment here chosen for the purpose of illustrating the present invention without departing from the scope thereof as defined in the appended claims.

I claim:

1. A sootblower assembly of the type having a straight, hollow, tubular lance body having a longitudinal axis and having a closed end portion, said body being rotatable about its axis, said body having an interior adopted to receive a compressible fluid cleaning agent under pressure, the improvement comprising:

(a) a nozzle member protruding in a sidewise direction through said body, said nozzle member having an inner end within said interior of said tube and an outer end exteriorly of said tube; and (b) said nozzle member having an array of individually spaced Venturi nozzles, each of said nozzles forming an individual nozzle opening through said body from said inner end to said outer end of said body along an axis, the axes of said individual nozzles of said array being sufficiently close to each other that the cleaning fluid agent will pass simultaneously through said nozzles from the interior of said tube and be discharged in generally the same direction.

2. The sootblower defined in claim 1 wherein the axes of said nozzles are parallel to each other.

3. The sootblower defined in claim 1 wherein the axes of said nozzles are sufficiently close that the discharge from them merge into a single jet column.

4. The sootblower assembly defined in claim 1 wherein said nozzles each have a configuration which enables each individual nozzle to discharge the fluid cleaning agent in a fully expanded condition from that nozzle.

5. The sootblower defined in claim 1 wherein said nozzle member is a unitary integral member and the configuration and arrangement of said array of nozzles in said nozzle member is such that a common jet is formed by the discharge of said fluid from said array of nozzle and is in a fully expanded condition.

6. The sootblower defined in claim 1 wherein said array of nozzles includes three nozzles, the axes of which are equally spaced from each other around the central portion of said body.

7. The sootblower defined in claim 1 wherein said array of nozzles includes four nozzles, the axes of which are equally spaced from each other around the central portion of said body.

8. The sootblower defined in claim 1 wherein said array of nozzles includes five nozzles.

9. A process of producing a jet stream of fluid cleaning agent comprising:

(a) feeding a compressible fluid cleaning agent along a prescribed path into the interior of a tube, closed at one end;

(b) disposing a plurality of individual nozzles having axes and entrance ends and discharge end in juxtaposition so that said axes are generally parallel to each other and their entrance ends are in communication with said cleaning fluid within said tube;

(c) simultaneously directing said cleaning fluid through said nozzles, for producing said individual parallel streams of cleaning fluid;

(d) accelerating said streams of cleaning fluid while they are in said nozzles; and (e) simultaneously discharging said streams of cleaning fluid in parallel paths sufficiently close to each other that they expand individually and merge into a single columnar jet of cleaning fluid.

10. The process defined in claim 9 wherein said columnar jet is essentially fully expanded.

11. The process defined in claim 9 wherein said streams of cleaning fluid are respectively discharged each in an essentially fully expanded condition.

* * * * *